US007154400B2

(12) United States Patent
Owrutsky et al.

(10) Patent No.: US 7,154,400 B2
(45) Date of Patent: Dec. 26, 2006

(54) FIRE DETECTION METHOD

(75) Inventors: Jeffrey C. Owrutsky, Washington, DC (US); Daniel A. Steinhurst, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 164 days.

(21) Appl. No.: 10/885,528

(22) Filed: Jun. 28, 2004

(65) Prior Publication Data

US 2005/0012626 A1 Jan. 20, 2005

Related U.S. Application Data

(60) Provisional application No. 60/483,020, filed on Jun. 27, 2003.

(51) Int. Cl.
*G08B 17/12* (2006.01)

(52) U.S. Cl. ..... 340/578; 340/557; 340/583; 250/336.1; 348/207.99

(58) Field of Classification Search ..... 340/578, 340/577, 501, 517, 521, 540, 586, 587, 579, 340/583, 573.7; 250/330, 336.1, 338.1, 342; 348/207.99, 335, 342
See application file for complete search history.

(56) References Cited

U.S. PATENT DOCUMENTS 5,592,151 A * 1/1997 Rolih ..... 340/584
5,726,632 A * 3/1998 Barnes et al. ..... 340/577
5,937,077 A * 8/1999 Chan et al. ..... 382/100
6,937,743 B1 * 8/2005 Rizzotti et al. ..... 382/100

* cited by examiner

*Primary Examiner*—Daniel Wu
*Assistant Examiner*—Daniel Previl
(74) *Attorney, Agent, or Firm*—John J. Karasek; L. George Legg

(57) ABSTRACT

A method for detecting a fire while discriminating against false alarms in a monitored space containing obstructed and partially obstructed views includes the steps of positioning an infrared camera in a location where the camera has both a direct view of a first portion of the monitored space and an obstructed view of a second portion of the monitored space, the camera including a charge coupled device (CCD) array sensitive to wavelengths in the range of from about 400 to about 1000 nm and a long pass filter for transmitting wavelengths greater than about 700 nm; filtering out radiation wavelengths lower than about 700 nm; converting an electrical current from the CCD array to a signal input to a processor; processing the signal; and generating alarms when predetermined criteria are met to indicate the presence of a fire in one or both of the first portion of the monitored space and the second portion of the monitored space. Indirect radiation, such as radiation scattered and reflected from common building or shipboard materials and components, indicative of a fire can be detected. The method can be implemented with relatively low cost components. A benefit of using the invention in a system in combination with Video Image Detection Systems (VIDS) is that in principle both fire and smoke can be detected for an entire compartment without either kind of source having to be in the direct LOS of the cameras, so that the entire space can be monitored for both kinds of sources with a single system.

10 Claims, 3 Drawing Sheets

FIRE DETECTION METHOD

The present application claims the benefit of the priority filing date of provisional patent application No. 60/483,020, filed Jun. 27, 2003, incorporated herein by reference.

FIELD OF THE INVENTION

This invention relates to a method for fire detection using imaging sensors. More particularly, the invention relates to a fire detection method for sensing and detecting fire-generated radiation, including indirect radiation, with enhanced discrimination over the background image for flaming and hot sources.

BACKGROUND OF THE INVENTION

Fire detection systems and methods are employed in most commercial and industrial environments, as well as in shipboard environments that include commercial and naval maritime vessels. Conventional systems typically have disadvantages that include high false alarm rates, poor response times, and overall sensitivity problems. Although it is desirable to have a system that promptly and accurately responds to a fire occurrence, it as also necessary to provide one that is not activated by spurious events, especially if the space contains high-valued, sensitive materials or the release of a fire suppressant is involved.

Economical fire and smoke detectors are used in residential and commercial security, with a principal goal of high sensitivity and accuracy. The sensors are typically point detectors, such as photoionization, photoelectron, and heat sensors. Line detectors such as beam smoke detectors also have been deployed in warehouse-type compartments. These sensors rely on diffusion, the transport of smoke, heat or gases to operate. Some recently proposed systems incorporate different types of point detectors into a neural network, which may achieve better accuracy and response times than individual single sensors alone but lack the faster response time possible with remote sensing, e.g., optical detection. Remote sensing methods do not rely on effluent diffusion to operate.

An optical fire detector (OFD) can monitor a space remotely, i.e. without having to rely on diffusion, and in principle can respond faster than point detectors. A drawback is that it is most effective with a direct line of sight (LOS) to the source, therefore a single detector may not provide effective coverage for a monitored space. Commercial OFDs typically employ a single/multiple detection approach, sensing emitted radiation in narrow spectral regions where flames emit strongly. Most OFDs include mid infrared (MIR) detection, particularly at 4.3 μm, where there is strong emission from carbon dioxide. OFDs are effective at monitoring a wide area, but these are primarily flame detectors and not very sensitive to smoldering fires. These are also not effective for detecting hot objects or reflected light. This is due to the sensitivity trade-offs necessary to keep the false alarm rates for the OFDs low. Other approaches such as thermal imaging using a mid infrared camera are generally too expensive for most applications.

Video Image Detection Systems (VIDS), such as the Fire Sentry VSD-8, are a recent development. These use video cameras operating in the visible range and analyze the images using machine vision. These are most effective at identifying smoke and less successful at detecting flame, particularly for small, emergent source (either directly or indirectly viewed, or hot objects). Hybrid or combined systems incorporating VIDS have been developed in which additional functionality is achieved using radiation emission sensor-based systems for improved response times, better false alarm resistance, and better coverage of the area with a minimum number of sensors, especially for obstructed or cluttered spaces U.S. Pat. No. 5,937,077, Chan et al., describes an imaging flame detection system that uses a charge coupled device (CCD) array sensitive in the IR range to detect IR images indicative of a fire. A narrow band IR filter centered at 1,140 nm is provided to remove false alarms resulting from the background image. Its disadvantages include that it does not sense in the visible or near-IR region, and it does not disclose the capability to detect reflected or indirect radiation from a fire, limiting its effectiveness, especially regarding the goal of maximum area coverage for spaces that are cluttered in which many areas cannot be monitored via line of sight detection using a single sensor unit. U.S. Pat. No. 6,111,511, Sivathanu et al., describes photodiode detector reflected radiation detection capability but does not describe an image detection capability. The lack of an imaging capability limits its usefulness in discriminating between real fires and false alarms and in identifying the nature of the source emission, which is presumably hot. This approach is more suitable for background-free environments, e.g., for monitoring forest fires, tunnels, or aircraft cargo bays, but is not as robust for indoor environments or those with a significant background variation difficult to discriminate against.

U.S. Pat. No. 6,529,132, G. Boucourt, discloses a device for monitoring an enclosure, such as an aircraft hold, that includes a CCD sensor-based camera, sensitive in the range of 0.4 μm to 1.1 μm, fitted with an infrared filter filtering between 0.4 μm and 0.8 μm. The device is positioned to detect the shifting of contents in the hold as well as to detect direct radiation. It does not disclose a method of optimally positioning the device to detect obstructed views of fires by sensing indirect fire radiation or suggest a manner in which the device would be installed in a ship space. The disclosed motion detection method is limited to image scenes with little or no dynamic motion.

It is desirable to provide a fire detection method that can detect images and that can also sense indirect radiation, including reflected and scattered radiation.

SUMMARY OF THE INVENTION

According to the invention, a method for detecting a fire while discriminating against false alarms in a monitored a space containing obstructed and partially obstructed views includes the steps of positioning an infrared camera in a location where the camera has both a direct view of a first portion of the monitored space and an obstructed view of a second portion of the monitored space, the camera including a charge coupled device array sensitive to wavelengths in the range of from about 400 to about 1000 nm and a long pass filter for transmitting wavelengths greater than about 700 nm; filtering out radiation wavelengths lower than about 700 nm; converting an electrical current from the charge coupled device to a signal input to a processor; processing the signal; and generating alarms when predetermined criteria are met to indicate the presence of a fire in one or both of the first portion of the monitored space and the second portion of the monitored space.

Another embodiment is a method as above but using a filter that transmits part of the normal image, e.g., using a filter in the deep red such as near 650 nm, such that it would be possible to achieve both smoke and fire detection with an enhanced degree of sensitivity for the latter due to longer wavelength response that would be superimposed on the normal video image detection.

The invention allows for the simultaneous remote detection of flaming and smoldering fires and other surveillance/threat condition events within an environment such as a ship space. The nightvision video fire detection accesses both spectral and spatial information using inexpensive equipment, in that it exploits the long wavelength response (to about 1 micron) of standard, CCD arrays used in many video cameras (e.g., camcorders and surveillance cameras). Nightvision cameras are more sensitive to hot objects than are regular video cameras. Smoke, although readily discernible with regular cameras, is generally near room temperature and therefore does not emit strongly above the ambient background level in the wavelength region that is detected with nightvision cameras. Well-defined external illumination would be required to reliably detect smoke in a compartment with nightvision cameras.

The addition of a longpass (LP) filter transmitting light with wavelengths longer than a cutoff, typically in the range 700–900 nm, increases the contrast for flaming fire and hot objects, while suppressing the normal video images of the space.

The invention can be useful in conjunction with a other sensor system that incorporates other types of sensors, e.g., spectral-based volume sensors, to provide more comprehensive fire and smoke detection capabilities. The method results in an improved false alarm rate, e.g., eliminating spurious alarms (motion in scene, bright events, etc.), while exhibiting a faster response and the capability to detect fires in obstructed-view spaces. Indirect radiation, such as radiation scattered and reflected from common building or shipboard materials and components, indicative of a fire can be detected. The method can be implemented with relatively low cost components. A benefit of using the invention in a system in combination with VID systems is that in principle both fire and smoke can be detected for an entire compartment without either kind of source having to be in the direct LOS of the cameras, so that the entire space can be monitored for both kinds of sources with a single system. This yields an approach that has clear practical advantages over other systems that require direct LOS detection, such as OFDs, and that therefore necessitate the installation and maintenance of multiple units for complete coverage of a confined space.

Additional features and advantages of the present invention will be set forth in, or be apparent from, the detailed description of preferred embodiments which follows.

DETAILED DESCRIPTION OF THE PREFERRED EMBODIMENTS

Definitions: as used herein, the term "nightvision" refers to the NIR (<1 μm) spectral region. The term "indirect radiation" includes scattered radiation and reflected radiation.

Figure 1:
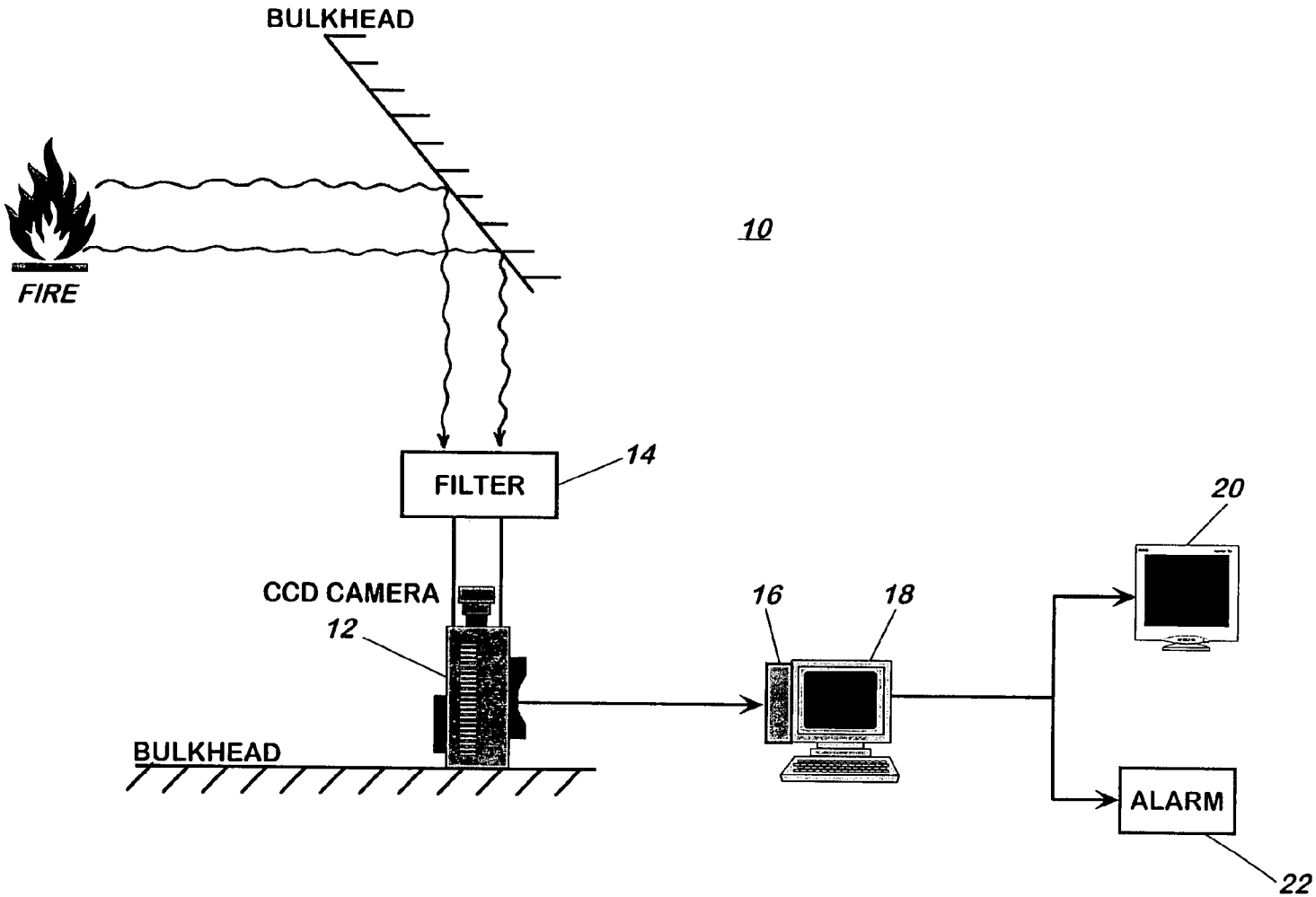
FIG. 1 is a schematic diagram of a representative fire detection system configuration useful for practicing the method according to the invention.
Figure 2A:
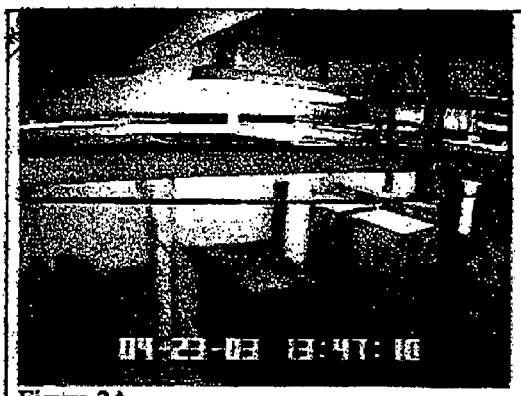
FIG. 2 is camera video from a test of the invention on the ex-USS Shadwell, showing regular and nightvision still images before and during a flaming event.
Figure 2B:
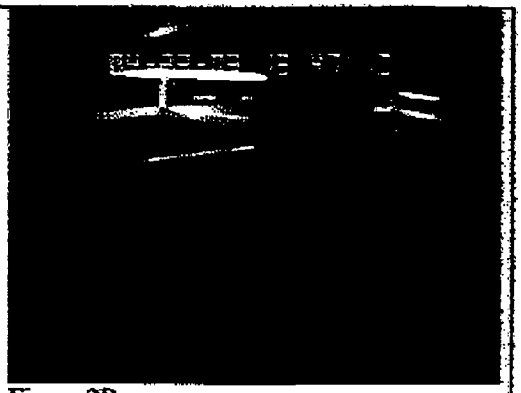
Figure 2C:
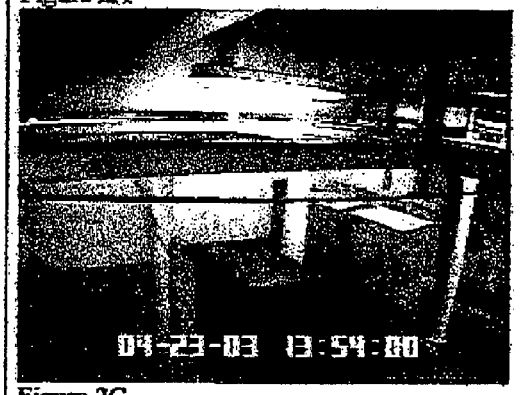
Figure 2D:
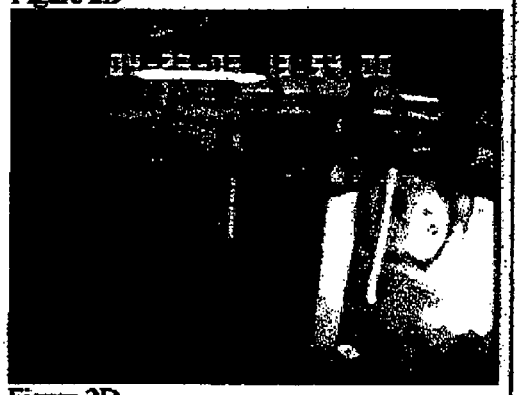
Figure 3A:
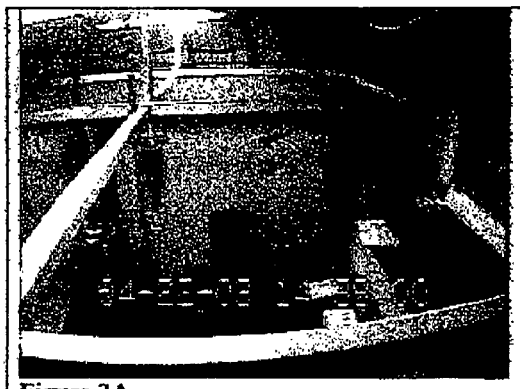
FIG. 3 shows regular and nightvision images before test ignition and during a flaming event outside the camera FOV from a test of the invention.
Figure 3B:
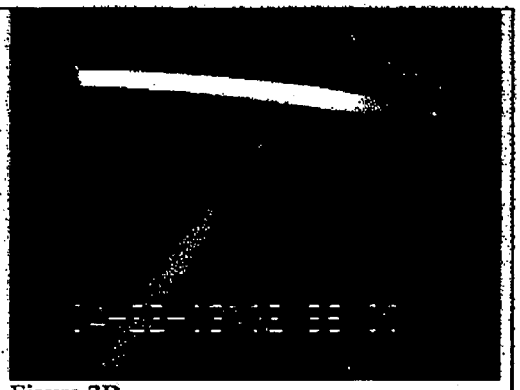
Figure 3C:
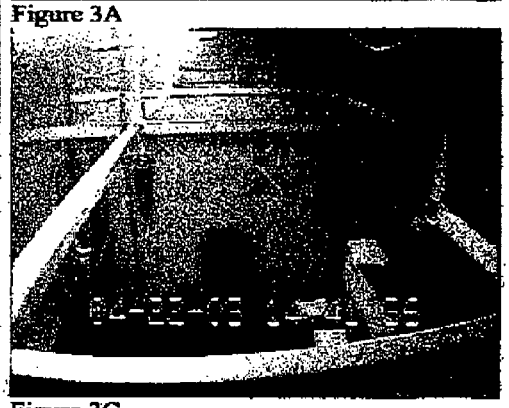
Figure 3D:
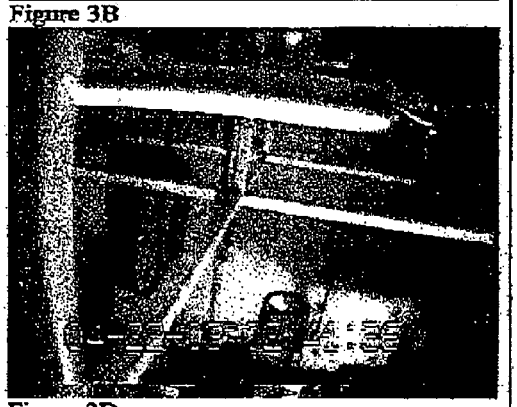

Referring now to FIG. 1, a fire detection apparatus 10 includes a CCD camera 12 in which the CCD array, such as the Sony CCD array ILX554B, is sensitive to wavelengths in the range of from about 400 nm to about 1000 nm. For example, camera 12 can be a commercial camcorder such as a Sony camcorder (DCR-TRV27) set in Nightshot mode, or an inexpensive "bullet", or surveillance, camera such as the CSI Speco (CVC-130R).

Camera 12 is fitted with a long pass filter 14 for increasing the contrast for flaming fire and hot objects while suppressing the normal video images in a monitored space that could generate false alarms or reduce detection sensitivity. Filter 14 in one embodiment preferably transmits wavelengths greater than about 700 nm, although it may be desirable depending on the application to select filter 14 to transmit wavelengths greater than 800 nm. Filter 14 filters out wavelengths that could cause false alarms or that could mask fire events.

Camera 12 outputs an image signal to an image signal acquisition device 16, e.g., a framegrabber such as the Belkin USB VideoBus II, and the image pixel data is transmitted to a processor 18. A captured and processed image and any resulting analysis are then output to a monitor 20 and/or an alarm annunciating system 22.

Among the various possible methods for implementing the image analysis as depicted as processor 18, for the development and demonstration of the invention a simple luminosity based algorithm was used. This analysis routine simply integrated the luminosity of the captured image and compares it to a reference or predetermined threshold luminosity, e.g., as disclosed in U.S. Pat. No. 6,529,132, incorporated herein by reference. The detection capability of the overall system relies primarily on the sensitivity and high contrast afforded by the images such that an effective system can be implemented with even the most rudimentary image analysis methods, e.g., using a simple luminosity summing based processing scheme. Developing an image based detection system that is effective with a straightforward luminosity analysis has several properties that make it an attractive quantity for evaluating the collected nightvision camera video. First, summation over a matrix of pixel intensities is a simple, fast operation to perform. The system is therefore easy to configure, such that the image quality constraints and processor hardware requirements are minimal. Complex image processing algorithms, such as those for VIDS, can require state-of-the-art computers with respect to processing power and memory as well as stringent requirements for image quality. The invention could be implemented in a compact fashion using a microprocessor for the analysis. Luminosity or similar image processing methods in which pixel intensities are integrated tend to average out random variations in low-light level images, so that the image quality has less of an impact on the system performance with respect to sensitivity and accuracy, in contrast to most VID systems. Degradation of the image quality is moderated as substantially all the captured intensity is detected by a CCD element while the summation removes spatial information. Second, the luminosity captures the fire characteristics described above. Luminosity directly tracks changes in the overall brightness of the video frame. Luminosities of sequential video frames may be compactly stored for use with signal processing filters and to examine time series for spatial growth of non-flickering, bright regions. The luminosity of the current video frame may be compared to the luminosity of a reference frame to allow for background subtraction. Finally, the approach provides a high degree of false alarm rejection because nuisance sources that do not emit NIR radiation and/or do not greatly affect the overall brightness of the video image are naturally rejected. For example, people moving about in the camera's field-of-view induce almost no change in the luminosity. Processor 18 is preferably programmed such that a persistence criteria or threshold is met or exceeded to establish an alarm state. Once attaining an alarm state, optionally a fire suppressant (not illustrated) may be automatically released into the affected area.

Certain fire-like nuisance sources significantly affect the total brightness of an image and the resultant luminosity. Welding and grinding sources are examples of such sources. The luminosity profiles for such events, however, exhibit different temporal behavior than those for fire sources. Other nuisance sources affect the reference luminosity by changing the background illumination. For example, lights being turned on or off dramatically change the background luminosity value but have a unique, step-like associated luminosity change which could be discriminated against. More sophisticated image processing could be used for enhanced performance, e.g., using spatially and temporally resolved approaches that include some degree of pattern recognition and motion detection in combination with noncontact temperature measurement to achieve a more effective system for fire detection and false alarm rejection.

Camera 12 is positioned in a location where it senses both direct radiation as well as indirect radiation from a fire. Indirect radiation includes both scattered and reflected radiation. As shown in FIG. 1, illustrating a representative installation, shipboard camera 12 is placed on a bulkhead in a first compartment facing toward an opening in a second compartment. A fire in the second compartment emits radiation that is scattered and/or reflected from various surfaces including adjacent bulkheads toward camera 12. In this manner, system 10 detects the presence of fires both by camera 12 sensing direct radiation from a fire in its direct line of sight as well as sensing indirect radiation from fire sources located outside the direct view of the camera.

TESTS/RESULTS

The video signal from a nightvision camera was converted from analog to digital video format for suitable input into a computer. A program coded in Mathworks' numerical analysis software suite, MATLAB v6.5 (Release 13), was used to control the video input acquisition from the cameras and to analyze the video images. The latter was carried out using a straightforward luminosity-based algorithm for analysis of nightvision images. The design goal of the luminosity algorithm was to capture the enhanced sensitivity of the nightvision cameras to the thermal emission of fires, hot objects, and especially flame emission reflected off walls and around obstructions from a source fire not in the field of view (FOV) of the camera, thereby augmenting the event detection and discrimination capabilities of the VID systems. This goal was achieved by tracking changes in the overall brightness of the video image. Alarms were indicated in real time and alarm times were recorded to files for later retrieval and compilation into a database. A background video image was stored at the start of each test, as well as the alarm video image when an alarm occurred. Luminosity time series data were recorded for the entire test.

The results demonstrate that flaming fires are detected with greater sensitivity with filtered nightvision cameras than with regular cameras because there is more emission from hot objects at the longer wavelengths detected by the nightvision cameras. NIR emission from flames is easily visible to the nightvision cameras, which is not always the case for regular video cameras.

The point is demonstrated in FIG. 2, which consists of several panels of images extracted from the videos from a test. Panels a) and b) show images from a test aboard the Navy ship ex-USS Shadwell for the regular and the filtered nightvision cameras, respectively, prior to source ignition. The images in panels c) and d) are from the same cameras several minutes later while the cardboard box flaming source is burning in the lower right hand corner, within the camera FOV for the nightvision camera and just out of the camera FOV for the regular camera. The flame is evident in both types of video. Emission from the flame can be seen on the surface of the nearest cabinet in the regular video image, but a more dramatic change is observed in the nightvision camera image, in which the lower right-hand quadrant is brightly illuminated. Although this example is somewhat biased because the fire is in the FOV of the nightvision camera and not the regular camera, it nevertheless demonstrates the high sensitivity of the method of the invention. The images are more informative so that less is required of the image analysis for detection and identification. A simple luminosity algorithm would be much less effective for regular video images.

Another example is shown in FIG. 3 for a source that is completely outside the FOV of all cameras. The source for this test was several cardboard boxes placed on the deck against the aft bulkhead. This position is below and behind the FOV of the camera. Panels a) and b) show images obtained prior to ignition of the source from the regular and nightvision cameras, respectively. The images in panels c) and d) were acquired several minutes after ignition when the source was fully engulfed in flame. Little or no difference can be seen between the regular images, with the exception of what appears to be smoke in the upper left-hand portion of the image. There is, however, a marked difference between the two nightvision images. NIR emission from the flame illuminates the entire area within the camera FOV. In the nightvision video, the NIR illumination fluctuates with the same temporal profile as the flame itself. This suggests that reflected NIR light could be used to detect flames that are out of the camera FOV based on time-series analysis of the camera video alone.

NIR radiation from flaming and hot objects is sufficiently intense in the observation band of the nightvision cameras (700–1000 nm) to quickly detect fires and hot objects such as overheated cables and ship bulkheads heated by a fire in an adjacent compartment. The cameras used by the commercial VIDS are not sensitive in this spectral region and must rely on smoke generation to detect fires, which are smoldering or are outside the camera FOV. Smoke is not sufficiently hot to generate NIR radiation therefore any NIR-based VIDS would have to rely on ambient room illumination to visualize smoke. Since the ambient illumination is typically suppressed or removed by the LP filters used in the nightvision cameras, smoke is not easily detected by a system using only nightvision cameras. The fusion of standard VIDS, which have fairly robust smoke detection, with the enhanced detection of LOS and reflected flame as well as objects hotter than 400° C., provides a system capable of monitoring the entire space of a congested space with a minimum number of units.

The nightvision video fire detection accesses both spectral and spatial information using inexpensive equipment. The approach exploits the long wavelength response (to about 1 micron) of standard, i.e., inexpensive, CCD arrays used in many video cameras. This region is slightly to the red (700–1000 nm) of the ocular response (400–650 nm). There is more emission from hot objects in this spectral region than in the visible (<600 nm)

Detection of Near-InfraRed (NIR) emission from flaming fires is not limited to the camera FOV, but can also be detected in reflection and scattered radiation. Sources within the camera FOV appear as very bright objects, exhibit "flicker," or time-dependent intensities, and tend to grow in spatial extent as time progresses. Regions of the image that are common to both the camera FOV and within Line of Sight (LOS) of the source will reflect NIR emission from the source to the camera. These regions will appear to the viewer as emitting. For sufficiently large fire sources, the heat generated by the source can increase the temperature of the compartment bulkheads sufficiently that a nightvision camera can detect the change from an adjacent compartment. The temporal and spatial evolution of sources imaged by this absorption/reemission scheme are different than those for directly detected sources due to the moderating effect of the intermediate source.

Obviously many modifications and variations of the present invention are possible in the light of the above teachings. It is therefore to be understood that the scope of the invention should be determined by referring to the following appended claims.

We claim:

1. A method for detecting a fire while discriminating against false alarms in a monitored space containing obstructed and partially obstructed views, comprising the steps of:

positioning an infrared camera in a location where the camera has both a direct view of a first portion of the monitored space and an obstructed view of a second portion of the monitored space, wherein:

the camera includes a charge coupled device array sensitive to wavelengths in the range of from about 400 to about 1000 nm, and a long pass filter for transmitting wavelengths greater than about 700 nm;

filtering out radiation wavelengths lower than about 700 nm;

converting an electrical current from the charge coupled device to a signal input to a processor;

processing the signal; and generating alarms when predetermined criteria are met to indicate the presence of a fire in one or both of the first portion of the monitored space and the second portion of the monitored space.

2. A method as in claim 1, wherein the monitored space is in a ship.

3. A method as in claim 1, further comprising a plurality of cameras positioned in a plurality of locations.

4. A method as in claim 1, wherein a reflected flame is sensed.

5. A method as in claim 1, further comprising positioning diverse detection system components in a plurality of spaces to achieve increased accuracy, detection capability, and response time.

6. A method for detecting a fire while discriminating against false alarms in a monitored a space containing obstructed and partially obstructed views, comprising the steps of:

positioning a plurality of infrared cameras each in a location where the camera has both a direct view of a first portion of a monitored space and an obstructed view of a second portion of a monitored space, wherein:

each camera includes a charge coupled device array sensitive to wavelengths in the range of from about 400 to about 1000 nm, and a long pass filter for transmitting wavelengths greater than about 700 nm;

filtering out radiation wavelengths lower than about 700 nm in at least one camera of said plurality of cameras;

converting an electrical current from the charge coupled device in said at least one camera to a signal input to a processor;

processing the signal; and generating alarms when predetermined criteria are met to indicate the presence of a fire in one or both of the first portion of the monitored space and the second portion of the monitored space.

7. A method as in claim 6, wherein the monitored space is in a ship.

8. A method for detecting a fire while discriminating against false alarms in a monitored a space containing obstructed and partially obstructed views, comprising the steps of:

positioning an infrared camera in a location where the camera has both a direct view of a first portion of the monitored space and an obstructed view of a second portion of the monitored space, wherein:

the camera includes a charge coupled device array sensitive to wavelengths in the range of from about 400 to about 1000 nm, and a long pass filter for transmitting wavelengths greater than about 700 nm;

filtering out radiation wavelengths lower than about 650 nm;

converting an electrical current from the charge coupled device to a signal input to a processor;

processing the signal; and generating alarms when predetermined criteria are met to indicate the presence of a fire in one or both of the first portion of the monitored space and the second portion of the monitored space.

9. A method as in claim 8, wherein the monitored space is in a ship.

10. A method as in claim 8, further comprising a plurality of cameras positioned in a plurality of locations.

* * * * *